US011408582B2

(12) United States Patent
Huang et al.

(10) Patent No.: US 11,408,582 B2
(45) Date of Patent: Aug. 9, 2022

(54) ILLUMINATION FEATURE FOR ELECTRONIC DEVICES

(71) Applicant: ECOLINK INTELLIGENT TECHNOLOGY, INC., Carlsbad, CA (US)

(72) Inventors: Jerry Huang, Tainan (TW); Eric Wang, Tainan (TW)

(73) Assignee: ECOLINK INTELLIGENT TECHNOLOGY, INC., Carlsbad, CA (US)

( * ) Notice: Subject to any disclaimer, the term of this patent is extended or adjusted under 35 U.S.C. 154(b) by 0 days.

(21) Appl. No.: 17/151,986

(22) Filed: Jan. 19, 2021

(65) Prior Publication Data

US 2021/0148541 A1 May 20, 2021

Related U.S. Application Data

(60) Division of application No. 16/436,054, filed on Jun. 10, 2019, now Pat. No. 10,895,363, which is a continuation of application No. 15/843,925, filed on Dec. 15, 2017, now Pat. No. 10,344,943, which is a continuation of application No. 15/837,721, filed on Dec. 11, 2017, now Pat. No. 10,203,084.

(51) Int. Cl.

| | |
|---|---|
| ***F21V 3/02*** | (2006.01) |
| ***F21V 23/04*** | (2006.01) |
| ***G08B 5/36*** | (2006.01) |
| ***F21V 33/00*** | (2006.01) |
| ***G08B 13/08*** | (2006.01) |
| ***G09F 13/00*** | (2006.01) |
| *F21Y 115/10* | (2016.01) |

(52) U.S. Cl.

CPC ..... *F21V 3/02* (2013.01); *F21V 23/0471* (2013.01); *F21V 33/0076* (2013.01); *G08B 5/36* (2013.01); *G08B 13/08* (2013.01); *G09F 13/005* (2013.01); *F21Y 2115/10* (2016.08)

(58) Field of Classification Search

CPC ..... G02B 5/36; G02B 13/08; H01H 13/18; F21V 3/02; F21V 23/0471; F21V 33/0076

See application file for complete search history.

(56) References Cited

U.S. PATENT DOCUMENTS

| | | | |
|---|---|---|---|
| 9,896,023 | B1 | 2/2018 | Salter et al. |
| 10,203,084 | B1 | 2/2019 | Huang |
| 10,344,943 | B2 | 7/2019 | Huang |
| 2009/0219730 | A1 | 9/2009 | Syfert |
| 2013/0208473 | A1 | 8/2013 | Palagashvili et al. |

FOREIGN PATENT DOCUMENTS

| | | | |
|---|---|---|---|
| WO | 2017/172943 | A1 | 10/2017 |

OTHER PUBLICATIONS

EPO, extended European search report issued on European patent application No. 18888070.2, dated Aug. 11, 2021, 10 pages.

ISA/US, International Search Report and Written Opinion issued on PCT application No. US18/59299, dated Dec. 14, 2018, 11 pages.

United States Patent and Trademark Office, Non-Final Office Action issued on U.S. Appl. No. 15/843,925, dated May 11, 2018, 12 pgs.

*Primary Examiner* — Karabi Guharay

(74) *Attorney, Agent, or Firm* — Greenberg Traurig, LLP

(57) ABSTRACT

The present disclosure provides an illumination feature for an electronic device. A light cone is used to direct light from a light emitter to an interior surface of a housing of an electronic device in one of a variety of geometric, alphabetic, or numerical designs.

15 Claims, 8 Drawing Sheets

ILLUMINATION FEATURE FOR ELECTRONIC DEVICES

CROSS-REFERENCE TO RELATED APPLICATIONS

This application is a divisional of U.S. patent application Ser. No. 16/436,054, filed Jun. 10, 2019, now U.S. Pat. No. 10,895,363, which is a continuation of U.S. patent application Ser. No. 15/843,925, filed on Dec. 15, 2017, now U.S. Pat. No. 10,344,943, which is a continuation of U.S. patent application Ser. No. 15/837,721, filed on Dec. 11, 2017, now U.S. Pat. No. 10,203,084.

BACKGROUND

Field of Use

The present application relates generally to electronic devices in general and more specifically to providing distinguishing features to an electronic device.

Description of the Related Art

Home security, monitoring, automation and control systems have been gaining popularity in recent years, providing homeowners with advanced monitoring and control in and around the home. Each of these systems typically comprises a central base station in communication with a number of sensors for determining an attribute of a premises, such whether any doors or windows are open, digital cameras for providing real-time video, and automation controls, such as Wi-Fi-enabled light bulbs, and switches.

As competition grows in this industry, manufacturers are looking for ways to differentiate themselves in the market. While trademarks are traditionally used for this purpose, manufacturers are looking for ways to remind consumers of their brand identity while the devices are operating in the home.

Brand recognition is important not only in the home security, monitoring and automation markets but, generally, in any market where electronics are used in plain sight of users.

It would be desirable, therefore, to introduce products into the marketplace that promote a manufacturer's brand identity.

SUMMARY

Embodiments of the present application are directed towards an electronic device having an illumination feature, comprising circuitry for performing a function, the circuitry comprising a circuit board and a light emitter mounted to the circuit board, a housing cover that contains the circuitry, and a light cone, disposed between the light emitter and the housing, for projecting a predetermined geometric outline onto an underside of the housing cover.

In another embodiment, an electronic device for projecting an illuminated, predefined geometric shape from an exterior surface of the electronic device is described, comprising a light emitter mounted to a circuit board, a housing cover for covering the circuit board, the housing cover comprising a channel formed into an underside surface of the housing cover and in vertical alignment with the light emitter, and a light cone disposed between the underside surface and the circuit board, comprising an annular projection surface mounted to the channel and an opposing distal end portion comprising a depression sized and shaped to receive the light emitter.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

Embodiments of the present invention provide an illumination feature to electronic devices. Such an illumination feature may serve an important brand-recognition function, as well as to provide status indications of an electronic device. The illumination feature comprises a shape, design or outline projected on an underside of a housing of the electronic device.

Figure 1:
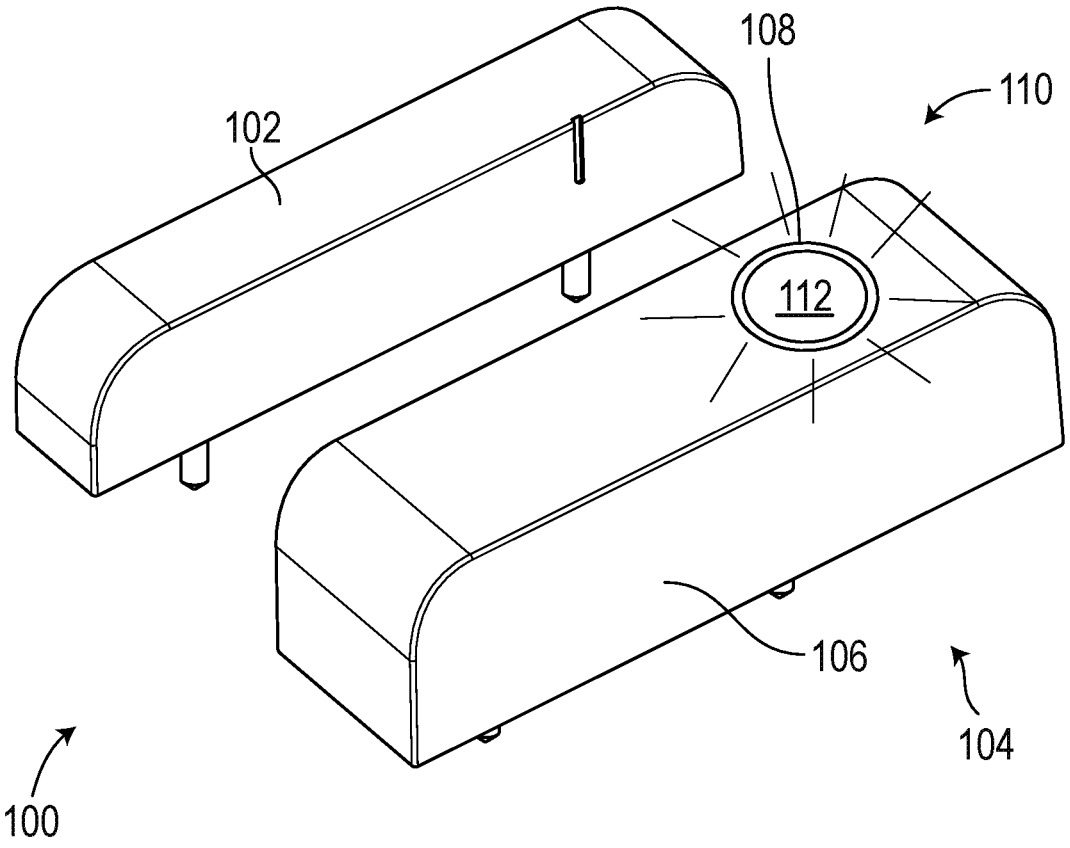
FIG. 1 is a perspective view of one embodiment of an electronic device comprising an illumination feature, in this embodiment, a door or window sensor used in home security systems to detect when a door or window has been opened.

FIG. 1 is a perspective view of one embodiment of an electronic device 100, in this embodiment, a door or window sensor used in home security systems to detect when a door or window has been opened. While the remainder of the discussion herein is in terms of such a door or window sensor, it should be understood that the principles discussed herein can be applied to almost any electronic device, whether home or business related, or whether battery powered or plugged in.

Electronic device 100 comprises magnet 102 and reed switch assembly 104. Reed switch assembly 104 is typically installed onto a door or window frame, while magnet 102 is installed onto a moving portion of a door or window, in proximity to reed switch 104 when the door or window is closed. A reed switch inside reed switch assembly 104 changes state when it detects that a magnetic field produced by magnet 102 is no longer present, i.e., when the door or window is opened, causing magnet 102 to be displaced from reed switch assembly 104.

Reed switch assembly additionally comprises an illumination feature that causes light to be emitted through a housing cover 106 of reed switch assembly 104. The light is shaped in the form of one or more geometric shapes, designs or outlines, in this embodiment, a circle or ring 108 of light 110 shining through housing cover 106 and projecting therefrom. In this embodiment, it should be noted that light does not shine through housing cover 106 in a center 112 of the circle 108.

Housing cover 106 is generally manufactured from an opaque material, such as plastic, polyaryletheretherketone, Polypropylene PP, ABS (such as ABS-747 manufactured by Chimei Corporation of Tainan, Taiwan), or some other material that is generally opaque. However, such opaque materials will generally allow at least some light to pass through, when the material is thin (i.e., less than 1 mm in thickness) and/or an intensity of the light is high (i.e., greater than 300 millicandelas (mcd). Housing cover 106 is typically constructed of such a plastic having a thickness to ensure that electronic device 100 is rugged to withstand handling, drops, and normal wear and tear (i.e., between 2 and 5 mm). This thickness generally prevents a low intensity light from passing. However, housing cover 106 is specially designed to allow a relatively low intensity light to pass, in almost any geometric shape, design or outline as explained in greater detail later herein.

Figure 2:
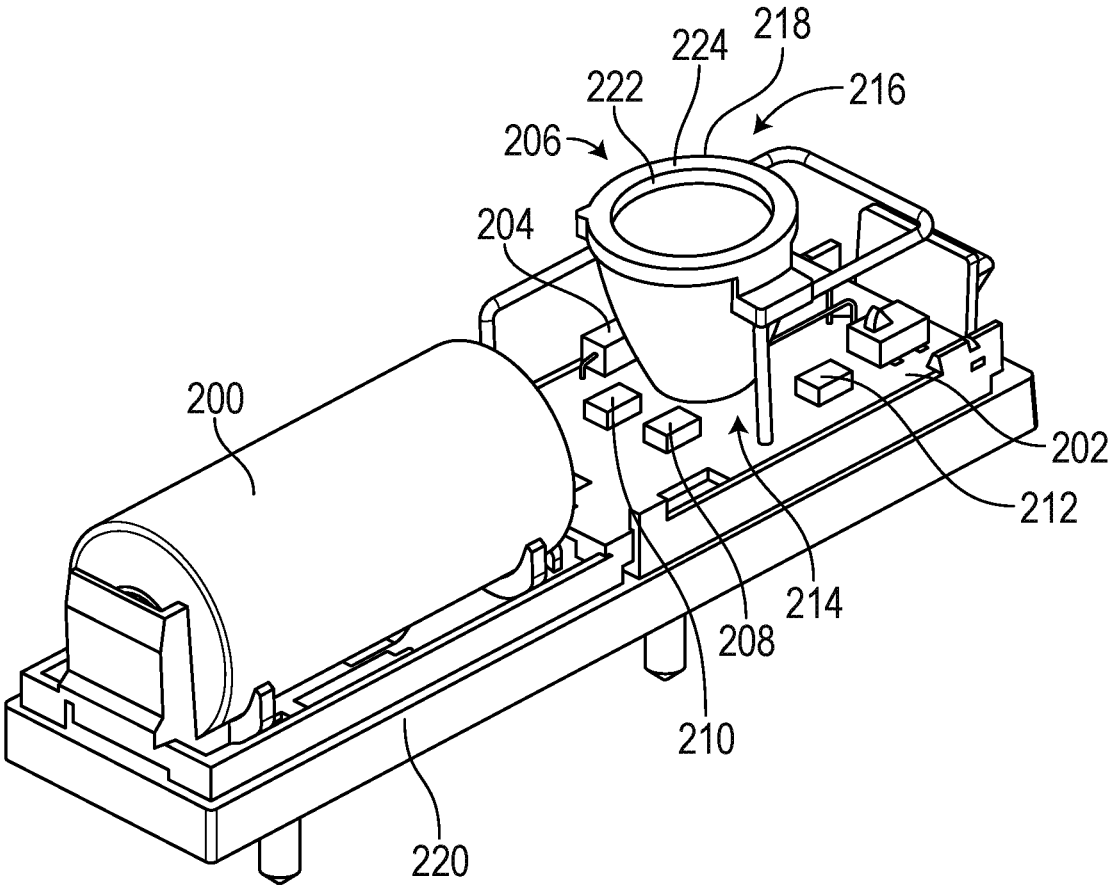
FIG. 2 is a perspective view of the electronic device shown in FIG. 1 with a housing cover removed.

FIG. 2 is a perspective view of reed switch assembly 104 with housing cover 106 removed. Shown is battery 200, circuit board 202, reed switch 204, light cone 206, processor 208 memory 210, transmitter 212 and housing base 220. Battery 200 supplies DC power to processor 208, memory 210 and/or other circuitry (not shown) either directly or through one or more voltage converters (also not shown) for operation of reed switch assembly 104. Reed switch 204 is used to sense a magnetic field generated by magnet 102 for sensing by processor 208. When processor 208 detects a change of state of reed switch 204, it causes transmitter 212 to transmit a wireless signal indicative of the state change and, typically, an identification of reed switch assembly 204, such a serial number. In addition, processor 208 may be programmed to cause the illumination feature light for a brief time, such as one second, as a visual confirmation that reed switch 104 detected that the door or window was opened and/or that a signal was transmitted to a remote location, typically a base station, gateway, panel or some other central receiver, typically located within a home or office building. Processor 208 may also be programmed to cause the illumination feature to light upon other predetermined events, such as when processor 208 detects that the voltage of battery 200 falls below a predetermined threshold, indicting a low battery condition, as a visual cue that reed switch 104 has entered or exited a "learn" mode, where reed switch 104 is initialized into a security or home monitoring or automation system, etc. In any of these cases, processor 208 may be programmed to cause the illumination feature to light for a predetermined time period, or periodically, as in the case of causing the illumination feature to flash rapidly or slowly, cycle on and off a predetermined number of times, etc.

Reed switch assembly 104 further comprises light cone 206 mounted as shown above a light emitter (not shown) mounted to circuit board 202. It should be understood that although reference is made throughout this disclosure of "light cone" 206, light cone 206 may not resemble a "cone", but may instead comprise a different geometric shape, such as a cylinder, rectangular prism, a diamond, a cube, or a curved shape. Circuit board 202 is in turn mounted to housing base 220. When housing cover 106 is placed over the assembly shown in FIG. 2, a distal end portion 214 of light cone 206 is located near or on circuit board 202, and a proximal end portion 216 is located near or against an inside surface of housing cover 106. Light cone 206 causes light emitted by the light emitter to be channeled to the inside surface of housing cover 106 in a shape, design or outline consistent with an area defined by outer perimeter 218 and inner perimeter 222 of light cone 206, forming an annular projection surface 224. While annular surface 224 of light cone 206 is shaped in the form of a ring in this embodiment, in other embodiments, it could be a width in that defines a square, rectangular, triangular, oval, or irregular, i.e., a geometric shape not defined by the traditional examples just given. In other embodiments, annular surface 224 might form a letter from the alphabet, a number, or a logo.

Figure 3:
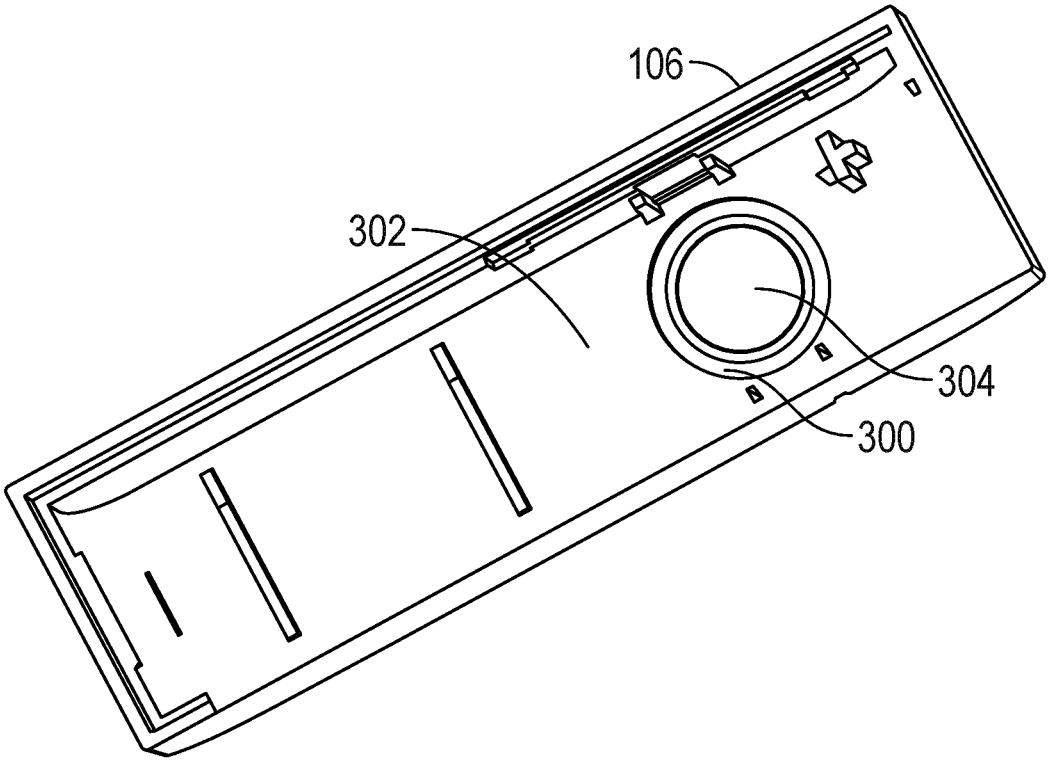
FIG. 3 is a top view looking down into an interior of the housing cover as shown in FIG. 1.

FIG. 3 is a top view looking down into the interior of housing cover 106. This view shows a channel 300 formed into the underside surface 302 of housing cover 106. Channel 302 is configured to conform to annular projection surface 224 of light cone 206 and further comprises a channel width just slightly larger than a width of annular projection surface 224. In some embodiment, the width of channel 302 is just slightly smaller than the width of annular projection surface 224 such that annular projection surface 224 of light cone 206 is wedged into channel 300 and remains in place due to a "pinching" force exerted against outer perimeter 214 by the material comprising underside surface 302. Channel 302 is formed into underside surface such that the thickness of housing cover 106 in area 304 is the same or similar as the thickness of housing cover 106 in an area outside of channel 300.

The thickness of housing cover 106 in the area near channel 300 is generally a thickness such that without channel 300, light passing from annular projection surface 224 of light cone 206 would not be seen on an exterior surface of reed switch assembly 104 by an observer, as the material would block the light from penetrating to the exterior surface. Channel 300 is formed at a depth that allows light to pass from annular projection surface 224 to the exterior surface. For example, housing cover 106 may be manufactured from ABS plastic material at a thickness in the area proximate to channel 300 of 2 mm. At this thickness with this particular material, light from annular projection surface 224 is not able to pass through housing cover 106 to the exterior surface of housing cover 106, depending, of course, on the intensity of light produced by a source of the light. However, because channel 300 is formed at a depth of about 1 mm or less, this reduces the thickness of housing cover 106 in an area abutting channel 300 from 2 mm to less than 1 mm. At this thickness, at least some of the light from annular projection surface 224 is able to pass housing cover 106 to the exterior surface, forming an illuminated shape, design or outline conforming to channel 300 (and annular projection surface 224) on the top surface of housing cover 106. In one embodiment, the thickness of housing cover 106 in the area near channel 300 is 2.2 mm, the thickness of housing cover 106 in channel 300 is 0.7 mm in an embodiment where the light emitter comprises an intensity of about 500 mcd, and light cone 206 is about 15 mm in length. In another embodiment, the thickness of housing cover 106 in the area near channel 300 is 2.7 mm, the thickness of housing cover 106 in channel 300 is 0.8 mm in an embodiment where the light emitter comprises an intensity of about 700 mcd, and light cone 206 is about 35 mm in length.

Figure 4:
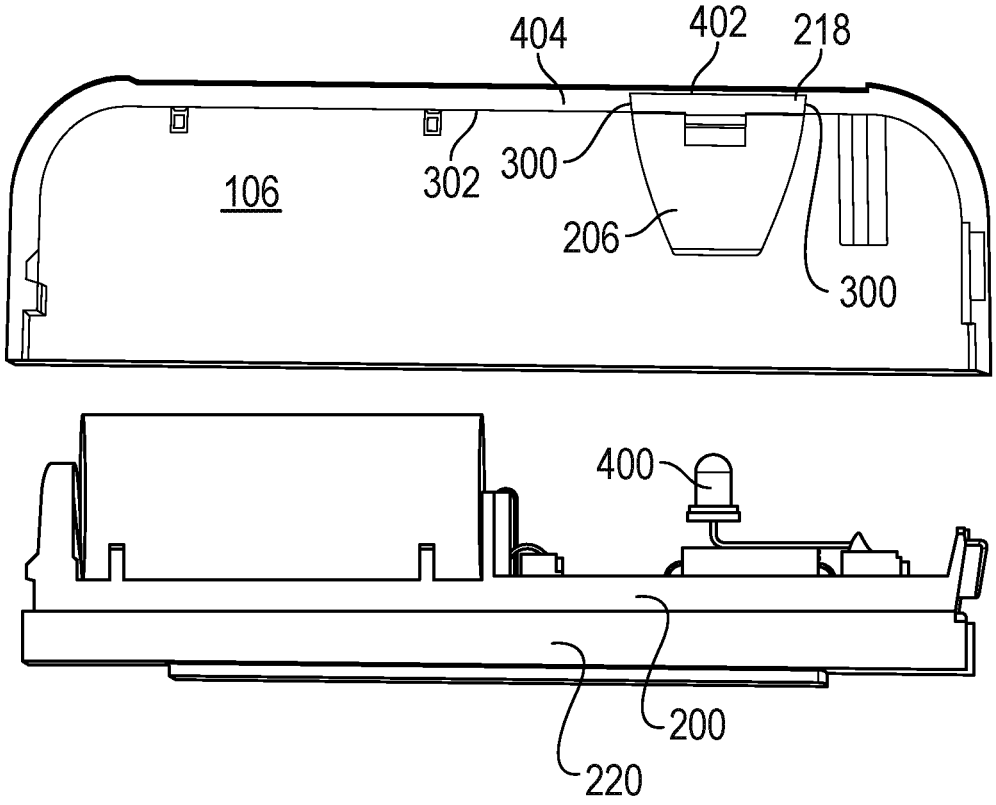
FIG. 4 is a side view of the electronic device shown in FIG. 1, with the housing cover suspended over and in alignment with an active portion of the electronic device.

FIG. 4 is a side view of reed switch assembly 104, shown with housing cover 106 suspended over and in alignment with the active portion of reed switch assembly 104, i.e., battery 200, circuit board 202, reed switch 204, light cone 206, processor 208 memory 210, and transmitter 212. Housing cover 106 is shown in a cutaway view, in order to show light cone 206. In this embodiment, light emitter 400 comprises a single LED including one of a variety of LED types, such "standard", organic, or quantum. For example, in one embodiment, a Cree® PLCC2 1 in 1 SMD LED CLM3A-BKW/GKW may be used, having a luminosity intensity range of between 355-900 millicandelas (mcd). In another embodiment, an AL455SA SMT LED is used, which has a luminosity intensity of between 150 and 850 mcd. The intensity of the LED is selected based on the material of housing cover 106 and the thickness of housing cover 106 above channel 300, i.e., the more opaque the material, and the thicker the material, the greater luminosity is required to penetrate the housing cover 106 above channel 300 in order to project light from the top surface of housing cover 106. The intensity may generally be changed by altering the voltage and, hence, the current applied to the LED. Still in other embodiments, two or more light emitters could be used, for example one light emitter being red, one being blue and one being green, and these could be controlled by processor 208 in order to display a wide variety of colors for passage through light cone 206. The intensity of light coming from light emitter 400 may vary based on factors such as light emitter type, voltage and/or current applied to the light emitter.

In the embodiment shown in FIG. 4, light emitter 400 comprises two leads corresponding to an anode and a cathode, respectively. However, in other embodiments, light emitter 400 could comprise a surface mounted LED, soldered directly to circuit board 202.

In this embodiment, light cone 206 is secured to channel 300, either mechanically in the manner previously discussed, by the use of one or more tabs, pins or other mechanical fastening means, or by an adhesive. Channel 300 and light cone 206 are positioned on housing cover 106 such that when assembled, distal end portion 214 of light cone 206 is in alignment with light emitter 400 and encompasses light emitter 400 as housing cover 106 is lowered towards circuit board 202 and secured into place to housing base 220. In one embodiment, distal end portion 214 covers light emitter 400 completely, while in other embodiments, light emitter 400 may be either partially covered or not covered at all, in an embodiment where distal end portion 214 rests just above light emitter 400. In any case, a height of light cone 400 is selected such that distal end portion 214 is vertically positioned in relation to light emitter 400 at a desired vertical distance when housing cover 106 is secured to housing base 220.

As shown in FIG. 4, channel 300 is formed into underside surface 302 of housing cover 106. The thickness of housing cover 106 is shown proximate to channel 300 as being thinner in an area 402 that defines the channel and thicker in an area 404 elsewhere. Light shines up from annular projection surface 224 of light cone 206 through channel 300 and forms a desired, lighted geometric shape, design or outline on the top surface 406 of housing cover 106.

Figure 5:
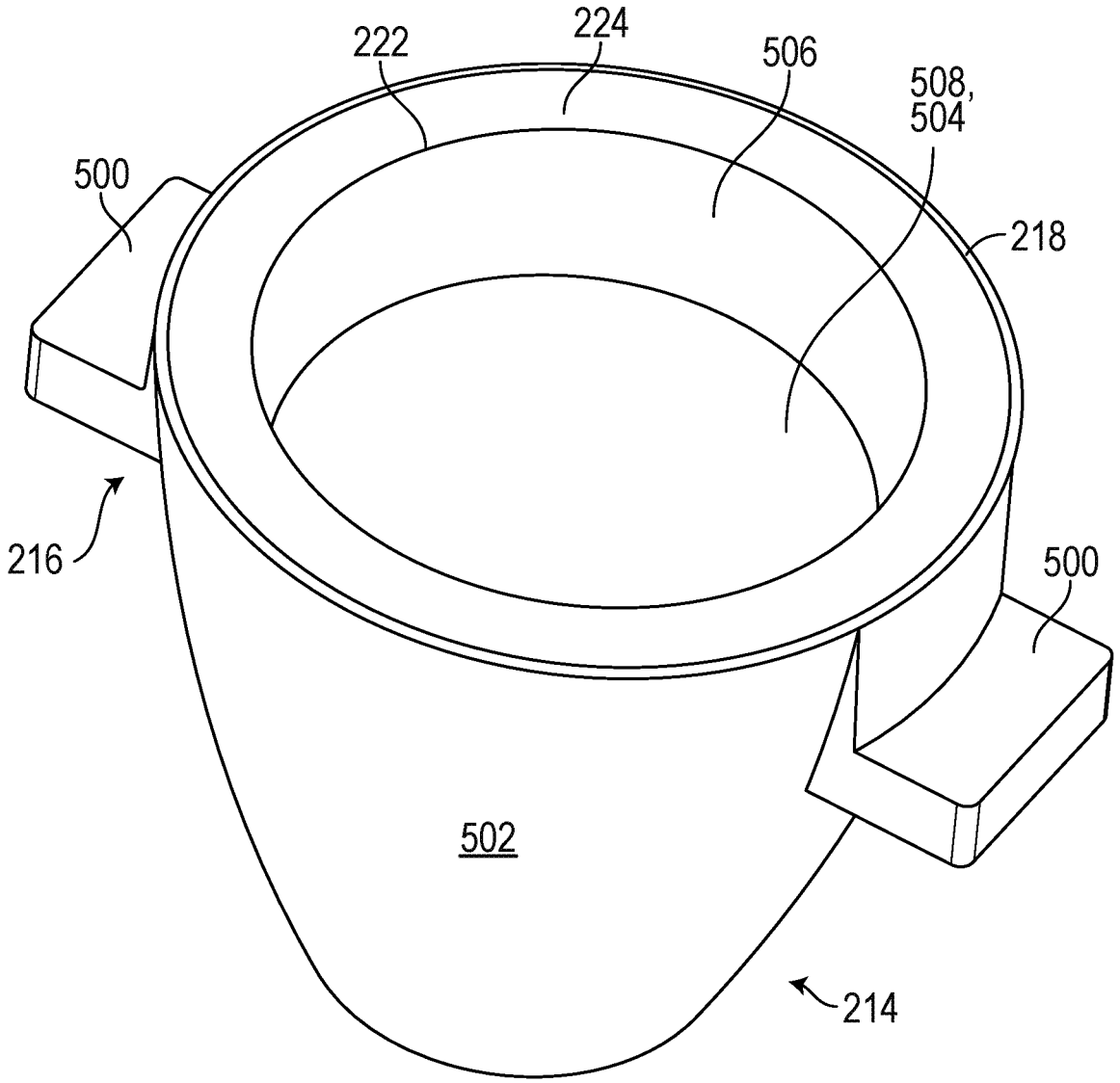
FIG. 5 is a close up, perspective view of a light cone used to project light onto an underside surface of the electronic device.

FIG. 5 is a close up, perspective view of light cone 206. In this embodiment, tabs 500 are formed as part of proximal end portion 216 of light cone 206 in order to provide a mechanism to support light cone 206 in an embodiment where light cone 206 is supported by mechanical extensions (not shown) from circuit board 202, or they may be snapped into corresponding receptacles that bind the tabs, respectively, to underside surface 302. Such a structure will be described in more detail, below.

In this embodiment, light cone 206 comprises a circular outer perimeter 218 and a circular inner perimeter 222 forming annular projection surface 224, and a semi-conical, semi-hollow body 502. Variations in the length and width of light cone 206 are contemplated, as well as the shape of perimeter 218. Light cone 206 comprises material 504 disposed inside light cone 206 or formed as part of light cone 206. At proximal end portion 216, annular projection surface 224 defines a wall thickness of wall 506. In other embodiments, material 504 completely fills light cone 206 up to inner perimeter 222. Material 504 is formed to block light from light emitter 400 from passing through light cone 206 in an area inside inner perimeter 222, while directing the light up through conical body 502 and annular projection surface 224. In this way, the light emitting from annular projection surface 224 is much more intense than any light that may come through material 504 from inside inner perimeter 222, thus directing the light to create a desired geometric shape, design or outline against channel 300. At least some of the light from annular projection surface 224 passes through housing cover 106 via channel 300, forming the desired, lighted geometric shape, design or outline on the top surface 406 of housing cover 106. Furthermore, the thicker portion of housing cover 106 in area 304, is usually the same thickness as the rest of housing cover 106, blocking any light from inside inner perimeter 222 from reaching top surface 406, i.e., inside ring 108.

Referring back to FIG. 5, material 504 extends down into light cone, tapering away from wall 506 to form an inner cone defined by wall 508. Material 504 may be the same material that is used to form light cone 206, or it may be different, but typically comprises an opaqueness that is more opaque than the material used to make light cone 206.

Figure 6:
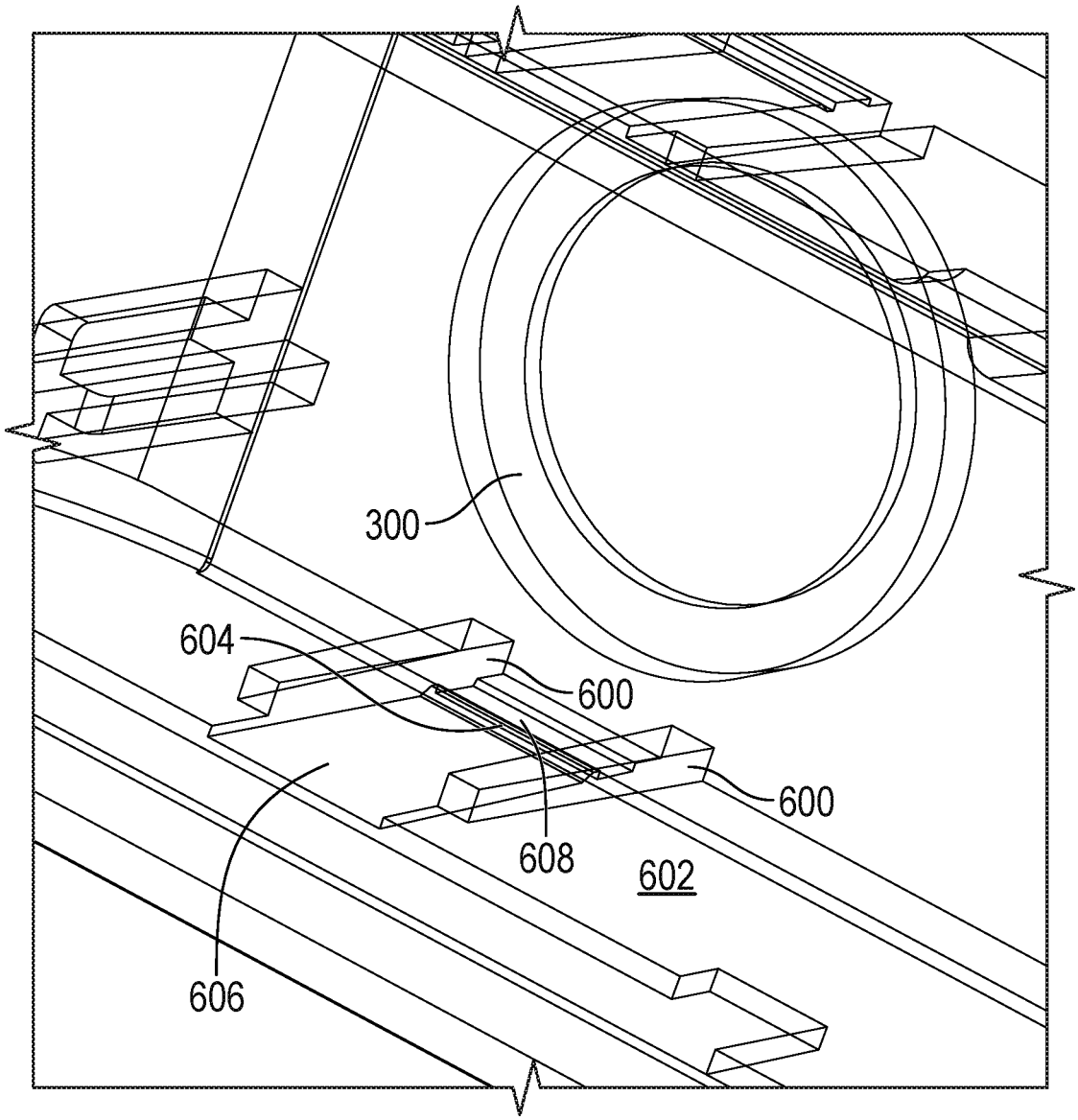
FIG. 6 is a close-up, perspective, wire-frame view of the housing cover as shown in FIGS. 1 and 3, detailing means for holding the light cone shown in FIG. 5 to a channel formed on an underside surface of the housing cover.

FIG. 6 is a close-up, perspective, wire-frame view of housing cover 106 detailing means for holding light cone 106 to channel 300. In this embodiment, two guide rails 600 are attached to an inner wall 602 of housing cover 106 as shown, proximate to channel 300. The rails 600 are spaced apart from one another by an amount such that when proximal end portion 216 is placed into channel 300, rails 600 make contact with perimeter 218 at two points around the circumference of perimeter 218 that are radially spaced apart from one another. By spacing rails 600 closer together, rails 600 makes contact with perimeter 218 at points closer together, thus exerting a smaller holding force on light cone 206 vs. spacing rails 600 further apart from one another, resulting in a greater holding force against light cone 206. In an exemplary embodiment, rails 600 are spaced apart from one another by approximately ½ of an inch.

Two pairs of rails 600 are used, one on wall 602 and the other on an opposing wall (not shown). The rails provide a guide for tabs 500 of light cone 206 to slide, such that annular projection surface 224 is positioned over channel 300 as perimeter 218 makes contact with all four rails. When annular projection surface 224 of light cone 206 contacts channel 300, tabs 500 slip over lip 604 and become lodged underneath lip 604, holding light cone 206 in place. A similar lip structure exists in conjunction with the other rail pair not shown. Light cone 206 may be removed by bending the walls of housing cover 106 outward from each other, thereby causing each of the lips to move outward and allowing tabs 500 to clear the lips. Clearance channels 606 and 608 may be formed into wall 602 to provide a guide channel for tab 500 to travel as it is being positioned onto channel 300. Guide channel 608 provides space for tab 500 once tab 500 has been captured by lip 604.

Figure 7:
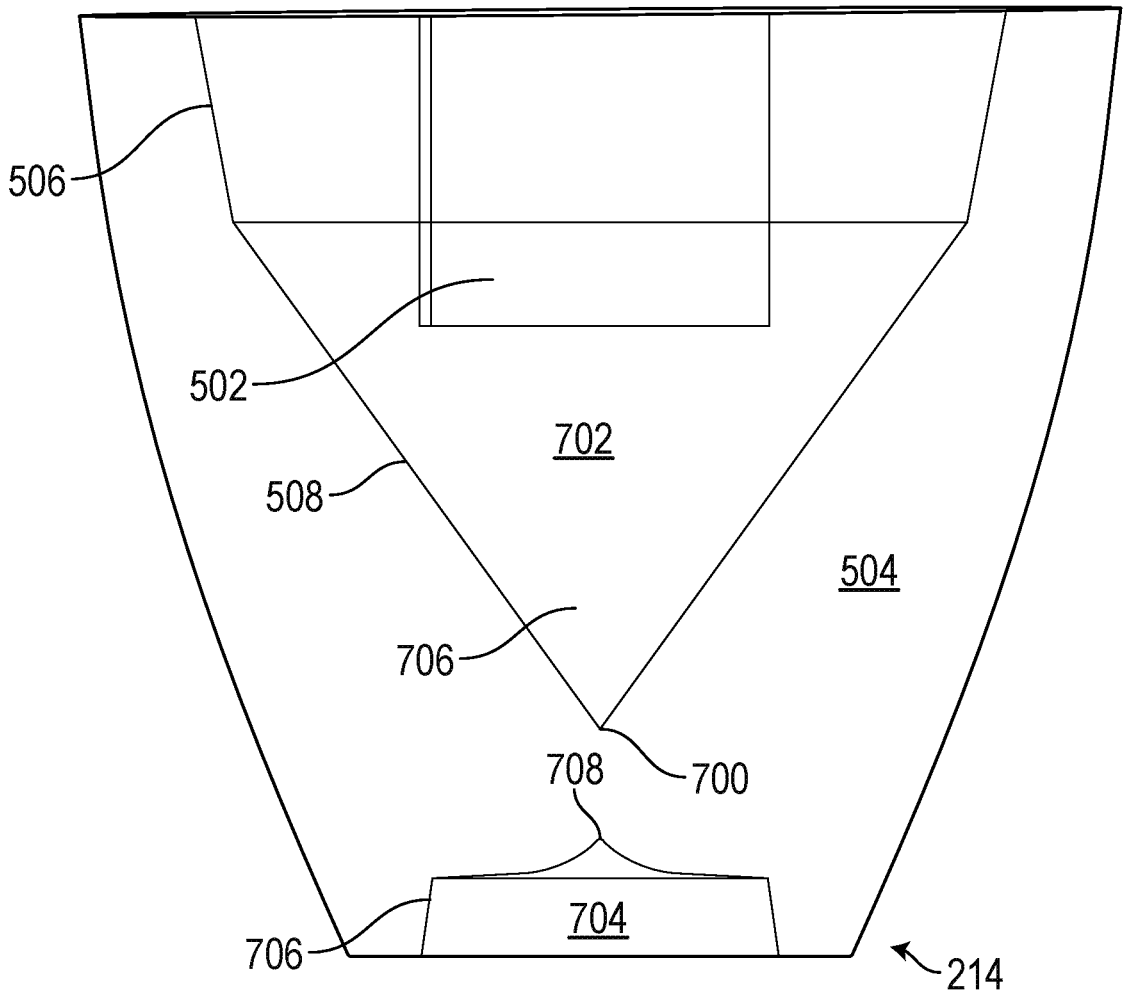
FIG. 7 is a close-up, transparent, side view of the light cone shown in FIG. 5.

FIG. 7 is a close-up, transparent, side view of light cone 206. In one embodiment, light cone 206 is 15.5 mm high, perimeter 218 is 15 mm in diameter and distal end portion 214 has a diameter of 7 mm at its narrowest end point. In another embodiment, light cone 206 is 35 mm high, perimeter 218 is 14.9 mm in diameter and distal end portion 214 has a diameter of 7 mm at its narrowest end point. It should be understood that these are just representative measurements, and that in other embodiments, the dimensions could be greater or smaller than the examples given. The walls and material 504 of light cone 206 may be made from the same material, or be made from different materials. In one embodiment, light cone 206 is manufactured as a homogeneous unit of the same material, comprising Poly(methyl methacrylate) (PMMA), also known as acrylic or acrylic glass as well as by the trade names Plexiglas, Acrylite, Lucite, and Perspex among several others. In other embodiments, the walls and material 504 are made from different materials, with the material selected for the conical body of light cone 206 comprising a light-permeable material, such as clear plastic or Poly material, while material 504 is more opaque, made from other types of plastic of Poly materials.

Wall 508 is shown as tapering down to apex 700 to form a three-dimensional void 702 inside light cone 206, resulting in a semi-hollow structure. Apex 700 points towards distal end portion 214. Similarly, a depression 704 is formed into distal end portion 214, defined by wall 706 and forming apex 708 pointing toward the apex 700, with some material 504 in between. In one embodiment, depression 704 is configured to completely envelop light emitter 400, i.e., the depth of depression 704 is sized to accommodate the height and width of a selected light emitter. In other embodiments, depression 704 is sized to accommodate only a portion of light emitter 400. In still other embodiments, depression 704 is not formed at all in distal end portion 214 in a case where distal end portion 214 is merely situated just above light emitter 400.

As light is produced by light emitter 400, it travels outwardly from light emitter 400 and enters material 504. Conical wall 502 and walls 506 and 508 may be polished to achieve or further enhance a glassy finish. In one embodiment, wall 706 is not polished. Polishing may increase a reflective property of material 504 at walls 502 and 508, causing light from light emitter 400 to bounce off of the walls and be re-directed back into material 504. Thus, the light tends to bounce off of walls 502 and 508 as it travels upwards towards perimeter 218. Some light may escape light cone 206 via walls 502 or 508, but most is directed towards perimeter 218. Thus, light cone 206 acts as a light conduit, forcing the light into a shape defined by annular projection surface 224.

When assembled, light cone 206 is secured into channel 300 of housing cover 106, and then housing cover 106 is placed over the internal components of reed switch assembly 104. Light cone 206 descends upon light emitter 400, with depression 704 encapsulating light emitter 400 as housing cover 106 is installed to housing base 220.

Figure 8:
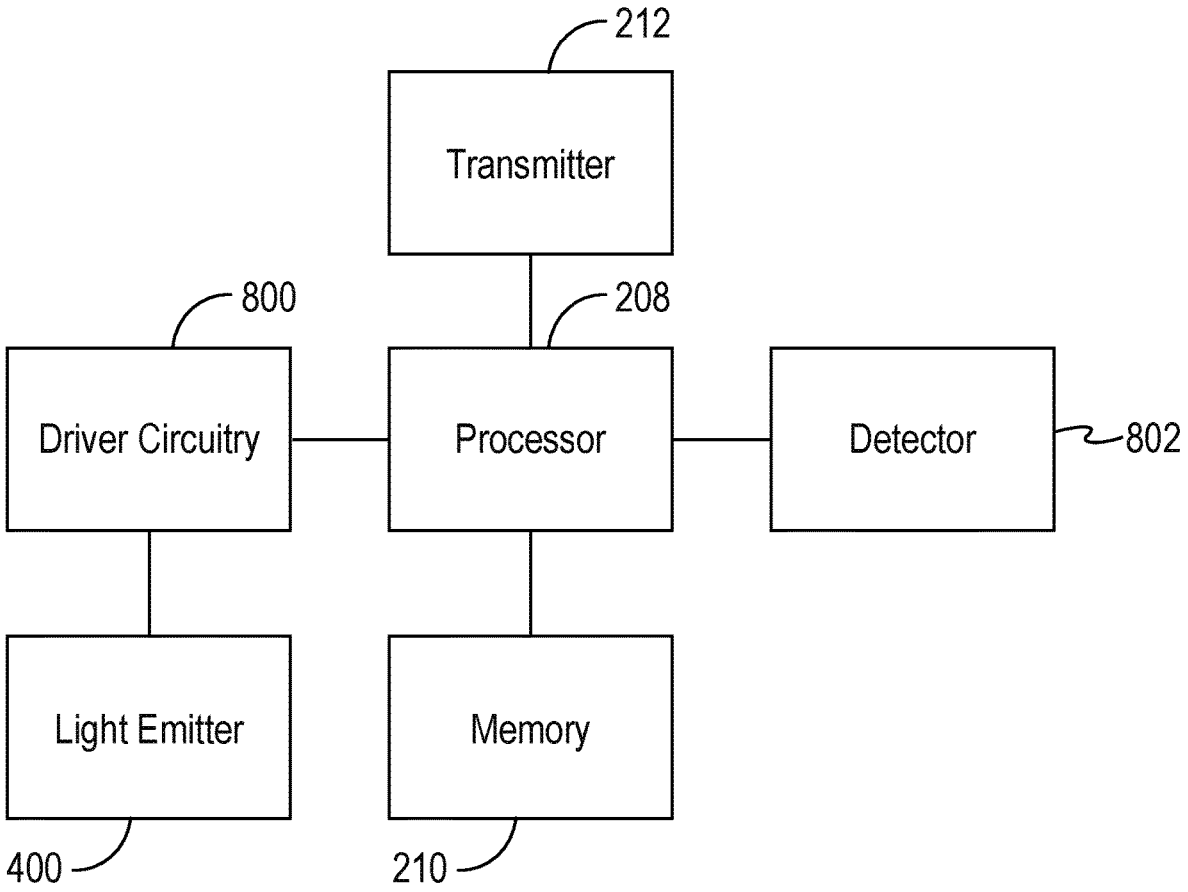
FIG. 8 is a functional block diagram of one embodiment of the electronic device as shown in FIG. 1.

FIG. 8 is a functional block diagram of one embodiment of electronic device 100. Shown is processor 208, memory 210, driver circuitry 800, detector 802 light emitter 400 and transmitter 212. It should be understood that other types of electronic devices may have different components that what is shown in FIG. 8.

Processor 208 is configured to provide general operation of electronic device 100 by executing processor-executable instructions stored in memory 802, for example, executable code. Processor 208 typically comprises a general purpose microprocessor or microcontroller able to fit within housing cover 106, while consuming very little power, enabling electronic device 100 to operate for many months or years before battery replacement becomes necessary. In other, non-battery applications, processor 208 may be selected based, in part, in knowing that power consumption is not a critical selection factor. Such a processor 208 may comprise a PIC12F635 or a PIC16F690 SSOP, both manufactured by Microchip Technology of Chandler, Ariz., although any one of a variety of microprocessors, microcomputers, and/or microcontrollers may be used alternatively.

Memory 210 comprises one or more non-transitory information storage devices, such as RAM, ROM, EEPROM, UVPROM, flash memory, SD memory, XD memory, or other type of electronic, optical, or mechanical memory device. Memory 210 is used to store processor-executable instructions for operation of electronic device 100, as well as any information used by electronic device 100, such as identification information (e.g., a serial number, device type ID, etc.), information for causing light emitter 400 to illuminate in one or more ways (such as steady on, blinking, illumination for 1 second, etc. in response to one or more events, such as entering a learn mode of operation, detecting that a door or window has been opened or closed, receiving an over-the-air update for the processor-executable instructions stored in memory 210. It should be understood that in some embodiments, memory 210 is incorporated into processor 208 and, further, that memory 802 excludes media for propagating signals.

Detector 806 is coupled to processor 400 and senses one or more conditions in an area proximate to electronic device 100. For example, detector 806 comprises reed switch 204 or hall-effect switch in an application where electronic device 100 comprises a door or window sensor, a motion sensor in an application where electronic device 100 comprises a passive infra-red sensor, a light detector, glass-breakage detector, a temperature sensor, or just about any device that detect a change in a condition occurring in proximity to electronic device 100.

Transmitter 212 comprises circuitry necessary to wirelessly transmit signals and to a destination such as a gateway, security panel, wireless router, etc. Such circuitry is well known in the art and may comprise Bluetooth, Wi-Fi, RF, optical, ultrasonic circuitry, among others. Alternatively, or in addition, transmitter 212 comprises well-known circuitry to provide signals to a destination via wiring, such as telephone wiring, twisted pair, two-conductor pair, CAT wiring, AC home wiring, or other type of wiring. In one embodiment, transmitter 212 may be replaced by a transceiver, for both sending and receiving wired or wireless signals, such as over-the-air updates for the processor-executable instructions stored in memory 210.

The methods or steps described in connection with the embodiments disclosed herein may be embodied directly in hardware or embodied in machine-readable instructions executed by a processor, or a combination of both. The machine-readable instructions may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. In the alternative, the processor and the storage medium may reside as discrete components.

Accordingly, an embodiment of the invention may comprise a non-transitory processor-readable media embodying code or machine-readable instructions to implement the teachings, methods, processes, algorithms, steps and/or functions disclosed herein.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

We claim:

1. A method for causing an illuminated geographic outline to appear on a sensor, comprising:

forming a circuit board, the circuit board comprising a light emitter;

forming a housing cover that contains the circuit board;

forming a light cone, the light cone for projecting light from the light emitter to an inside surface of the housing cover; and positioning the light cone between the light emitter and the inside surface of the housing cover;

wherein the geographic outline is projected onto the underside of the housing cover via the light cone when the light emitter is energized and wherein the housing cover is formed of an opaque material.

2. The method of claim 1, wherein the geometric outline is projected from an annular projection surface of the light cone.

3. The method of claim 1, further comprising: forming a channel that extends longitudinally into the inside surface of the housing cover, the channel sized and shaped to match a size and shape of a proximal end of the light cone nearest to the channel.

4. The method of claim 3, further comprising: providing two sets of opposing rails on two, inside wall surfaces of the housing cover, respectively; and sliding the light cone between the two sets of opposing rails until the proximal end of the light cone is seated into the channel.

5. The method of claim 4, wherein a distal end of the light cone is placed in proximity to the light emitter when the housing cover is placed over the circuit board.

6. The method of claim 3, wherein the light cone is in vertical alignment with the light emitter and the channel when the housing cover is placed over the circuit board.

7. The method of claim 3, wherein the housing cover comprises a first thickness in an area proximate to the channel, and a second thickness, thinner than the first thickness, in an area that defines the channel.

8. The method of claim 3, wherein the light emitter is selected based on a thickness of the channel.

9. The method of claim 1, wherein the light cone comprises a distal end configured to receive light from the light emitter and channel the light through a body of the light cone to a proximal end, the proximal end abutting the inside surface of the housing cover when the housing cover is placed over the circuit board.

10. The method of claim 9, wherein the distal end comprises a depression sized and shaped to encompass the light emitter when the housing cover is placed over the circuit board.

11. The method of claim 1, wherein the geometric shape comprises an annular ring.

12. The method of claim 1, further comprising: forming a channel that extends longitudinally into the inside surface of the housing cover, a width of the channel sized and shaped smaller than the width of a proximal end of the light cone such that the proximal end of the light cone is wedged into the channel by a pinching force exerted against the proximal end of the light cone by the channel.

13. The method of claim 1, wherein the light cone comprises: an internal, conical wall forming a first apex pointing towards a distal end portion of the light cone; and a second, internal wall formed into the distal end portion, forming a depression, the depression comprising a second apex pointing toward the first apex.

14. The method of claim 1, wherein the light cone is formed by polishing an outer wall of the light cone and polishing an internal conical wall of the light cone.

15. The method of claim 1, wherein the light emitter is selected based on a thickness of the housing cover.

* * * * *